US007044060B1

(12) United States Patent
Cornelius et al.

(10) Patent No.: US 7,044,060 B1
(45) Date of Patent: May 16, 2006

(54) MISSILE-BORNE EXPLOSIVE ACTIVATED GRENADE RELEASE DEVICE

(75) Inventors: Charles Stephen Cornelius, Huntsville, AL (US); Charles M. Vessels, Harvest, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/176,064

(22) Filed: Jul. 7, 2005

(51) Int. Cl.
*F42B 12/02* (2006.01)

(52) U.S. Cl. ..... 102/477; 102/489

(58) Field of Classification Search ..... 102/477, 102/489, 482
See application file for complete search history.

(56) References Cited

U.S. PATENT DOCUMENTS 1,045,671 A * 11/1912 Bureau ..... 102/477
4,220,091 A 9/1980 Israels et al.
5,107,766 A * 4/1992 Schliesske et al. ..... 102/373
5,561,261 A * 10/1996 Lindstadt et al. ..... 102/476
5,690,089 A 11/1997 Ward

* cited by examiner

*Primary Examiner*—Michael J. Carone
*Assistant Examiner*—Gabriel Klein
(74) *Attorney, Agent, or Firm*—Jack K Greer, Jr.; Michael K Gray; May Kyung Chang

(57) ABSTRACT

A delivery and release device for release and detonation of sequential explosive charges is disclosed to penetrate hardened structures. An aerodynamic shell is sized for delivery to a target by hand or mechanical means, including a first explosive charge is in a forward portion and a release device enclosing a second explosive charge is disposed in a shell rear portion. The release device includes a segmented cone positioned behind the first explosive charge, and a segmented cylindrical unit extending rearwards to enclose the second explosive charge within the shell during flight. Upon impact with the target, the first explosive charge detonates and directs high pressure gases against the target and deflection of gases rearwards against the segmented cone. The segmented cone and cylindrical unit are forced to separate and pivot outwards thereby releasing the second explosive charge for delayed delivery and detonation against the target leading to breach and destruction.

14 Claims, 7 Drawing Sheets

FIG. 4
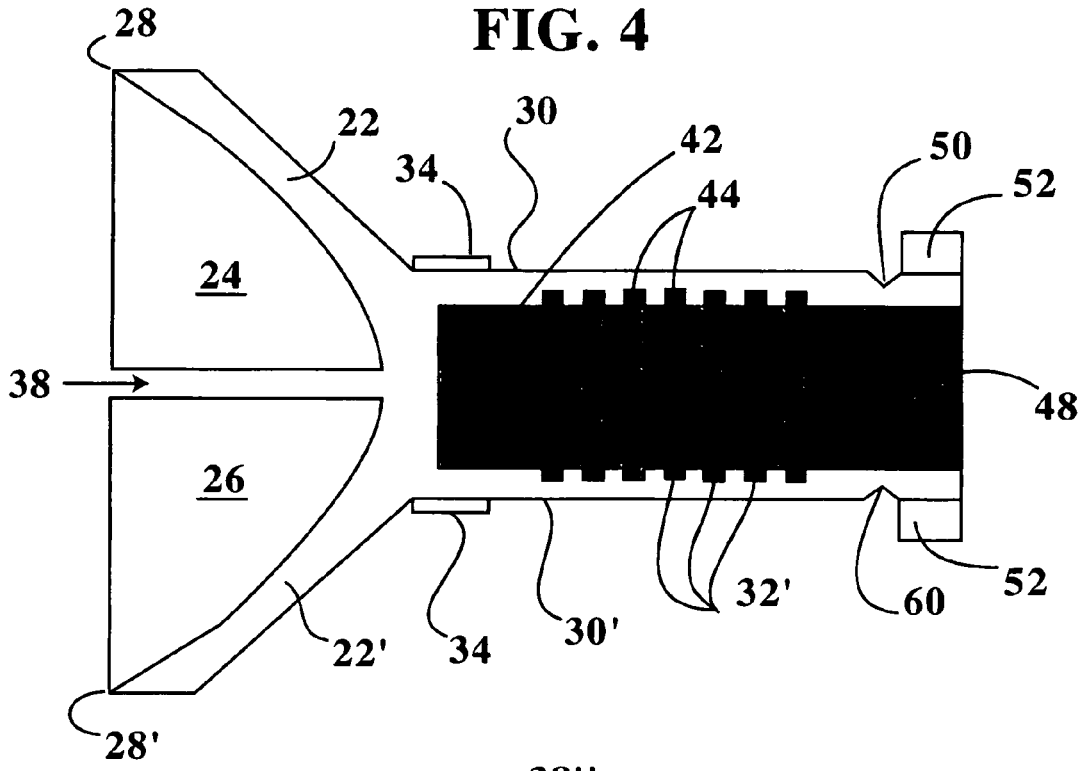
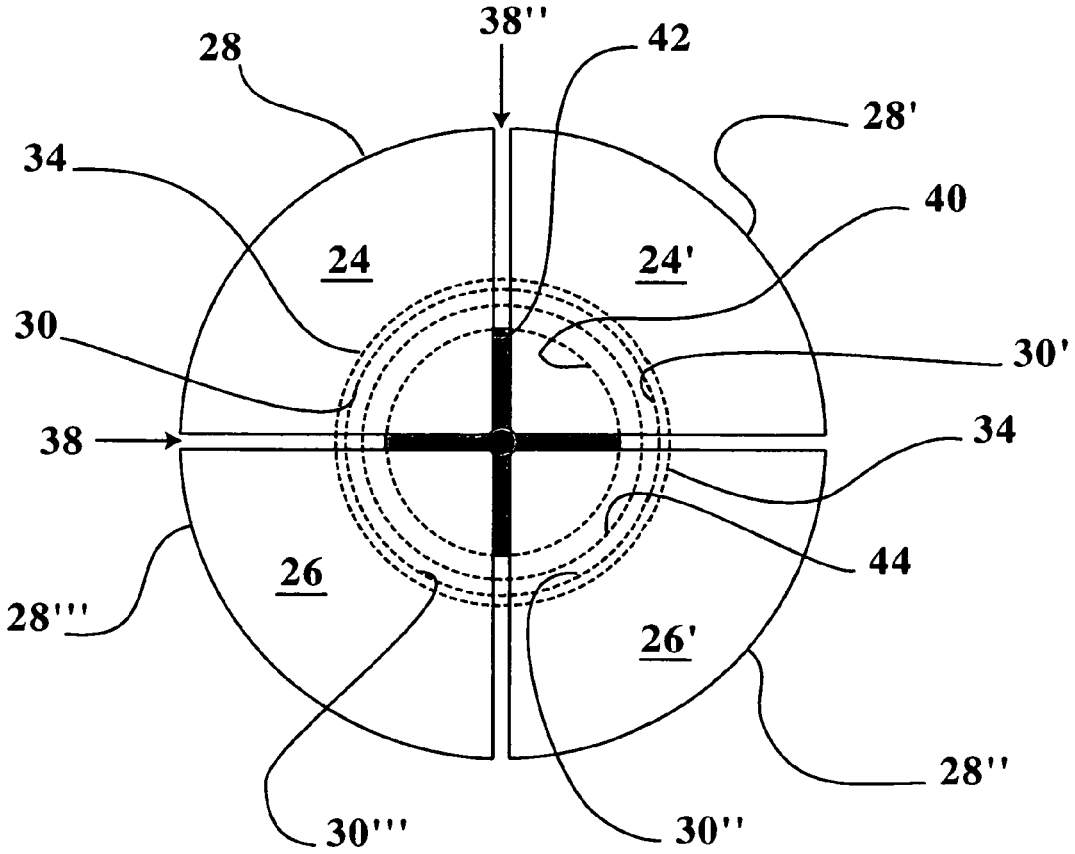
FIG. 5

MISSILE-BORNE EXPLOSIVE ACTIVATED GRENADE RELEASE DEVICE

STATEMENT REGARDING FEDERALLY SPONSORED RESEARCH OR DEVELOPMENT

The invention described herein may be manufactured, used and licensed by or for the Government for governmental purposes without the payment to the inventors of any royalties thereon.

CROSS-REFERENCE TO RELATED APPLICATIONS

Not Applicable.

BACKGROUND OF THE INVENTION

1. Field of the Invention

The invention relates to devices for release and directed delivery of explosive devices. More specifically, the present invention relates to a missile-borne grenade delivered by a release unit providing directed explosive force at a target.

2. Description of the Related Art

The use of hand-released grenade, missile and munition packages are well known in warfare (hereinafter referred to as "explosive unit" or "grenade"). Typically the explosive unit and any associated delivery device(s) are used to attack target structures such as buildings, bunkers and other fortifications before entry by infantry. Prior explosive units generally detonated upon impact with a target structure.

One example of a prior hand-launched grenade having a delay fuse is disclosed in U.S. Pat. No. 4,220,091, issued to S. H. Israels and S. Kosonocky and assigned to the U.S. Army. The explosive hand grenade includes an interior chamber having high explosive material therein, and a fuse having a spring mechanism for delay of ignition of an internal booster charge which results in detonation of the high explosive material within the interior chamber. Upon detonation, the hand-launched grenade shell expands equally in all directions to assert force against targets in a circumference of the target zone. The hand-launched grenade does not include a mechanism to direct explosive forces in a preferred direction against a target structure.

An example of a mechanical hand grenade launcher is disclosed in U.S. Pat. No. 5,690,089, issued to J. P. Ward and assigned to the U.S. Army. The hand grenade launcher includes an open launching end and an internal spring which is released for propelling the hand grenade to a target area. The mechanical hand grenade launcher does not include the capability to propel a hand grenade in a preferred orientation for impact and detonation against a target surface of a building, bunker, or other fortification typically found in urban warfare.

For grenade or missile applications directed at hardened target structures, repetitive detonations of separately packaged, multiple explosive charges have been utilized. Prior applications include one explosive charge detonated upon target impact with a second explosive charge being directed at the target by a delayed release from a launcher, thus providing repetitive explosions at the target structure. If a prior grenade or missile launcher does not provide adequate time delay or accuracy for delivery between first, second, and additional missiles to the target structure, either due to miscalculations by operator, malfunctions in software controlling the launcher, or movement of the launcher or the target, the additional missiles may not acquire and detonate at the target in close succession to maximize damage to the target structure.

An improved release device is needed to maintain a preferred orientation for a grenade during flight, to maximize accuracy for target impact, and to achieve a directed release of sequential explosive forces after target impact to attain penetration and/or destruction of the target.

BRIEF SUMMARY OF THE INVENTION

A missile-borne grenade release device is disclosed for delivery of multiple explosive charges to a target. The release device is configured with a first explosive charge positioned to be detonated upon impact with a target surface, followed by a second explosive charge being released and detonated against the target surface. Delivery and sequential detonation results in penetration of the target surface when utilized by infantry or released from vehicles supporting infantry during urban warfare.

The release device includes an elongated and sectioned release body sized to fit within an aerodynamically shaped munition shell such as a hand-held missile. Within the munition shell is a first explosive charge positioned forward of the release body. The first explosive charge is detonated upon impact of the forward portion of the munition shell against a target surface. One embodiment of the release body includes a sectioned outer surface which is longitudinally split into at least two segmented cylindrical units joined in alignment along a length axis of the release body. The segmented cylindrical units are sized in diameter and length to securely hold therein a second explosive charge such as a grenade body. During flight of the missile, the segmented cylindrical units are joined together by forward and rear securing rings. Each segmented cylindrical unit includes a forwardly extended partial cone portion having leading edges extending to a forward rim having a maximum diameter positioned a distance apart from and rearward of the first explosive charge. When the munition shell is assembled, the release body and second explosive charge are positioned within the middle and rear end of the sectioned release body, and are retained in an axially aligned position rearward of the first explosive charge by the rear securing ring encircling the rear end of the release body. The second explosive charge is maintained spaced apart from the first explosive charge during flight by contact between protrusions extending outwards from the grenade body external surface, and corresponding grooves within interior faced surfaces of the assembled release body.

The forward conical portion of each segmented cylindrical unit is maintained in a conical configuration behind the first explosive charge during flight. Upon detonation of the first explosive charge against a target surface, the forward conical portions are forced outwards and backwards by release of high pressure gasses from the detonated first explosive charge. In order to facilitate the opening of the forward conical portions, a designed weakness within the rear outer surface of each segmented cylindrical unit is provided by at least one circumferential groove therein. The circumferential grooves form a first and second hinged configuration for each rear outer surface of each segmented cylindrical unit. The circumferential grooves are positioned forward of the rear securing ring when the release body is assembled and disposed within the munition shell. Upon detonation of the first explosive charge against a target surface, an opening process similar to the opening of flower petals will occur for the release device in order to provide a forward directed release of the second explosive charge. The detonation of the first explosive charge provides high pressure gases directed forward and rearward. The rearwardly directed gasses impact the forward surfaces of the partial cone portions, resulting in each partial cone portion being forced apart and backwards. During the forced opening of each partial cone portion, an outwards pivoting pressure is applied at each circumferential groove forward of the rear securing ring, thereby allowing each cylindrical unit to pivot apart similar to flower petals opening outwards. Pivoting of each cylindrical unit provides release of the second explosive charge and allows forward movement to impact and explode at the pre-stressed target surface, thereby focusing a second sequence of high pressure gasses against the target surface in order to breach the target surface.

BRIEF DESCRIPTION OF THE DRAWINGS

The present invention is illustrated in the drawings in which like element numbers represent like parts in each figure, including:

FIG. 4 is a side view of a second explosive charge positioned in the release device;

FIG. 5 is a front view of the release device illustrating a plurality of partial cone portions and segmented cylindrical units enclosing the second explosive charge;

DETAILED DESCRIPTION OF THE INVENTION

Figure 1:
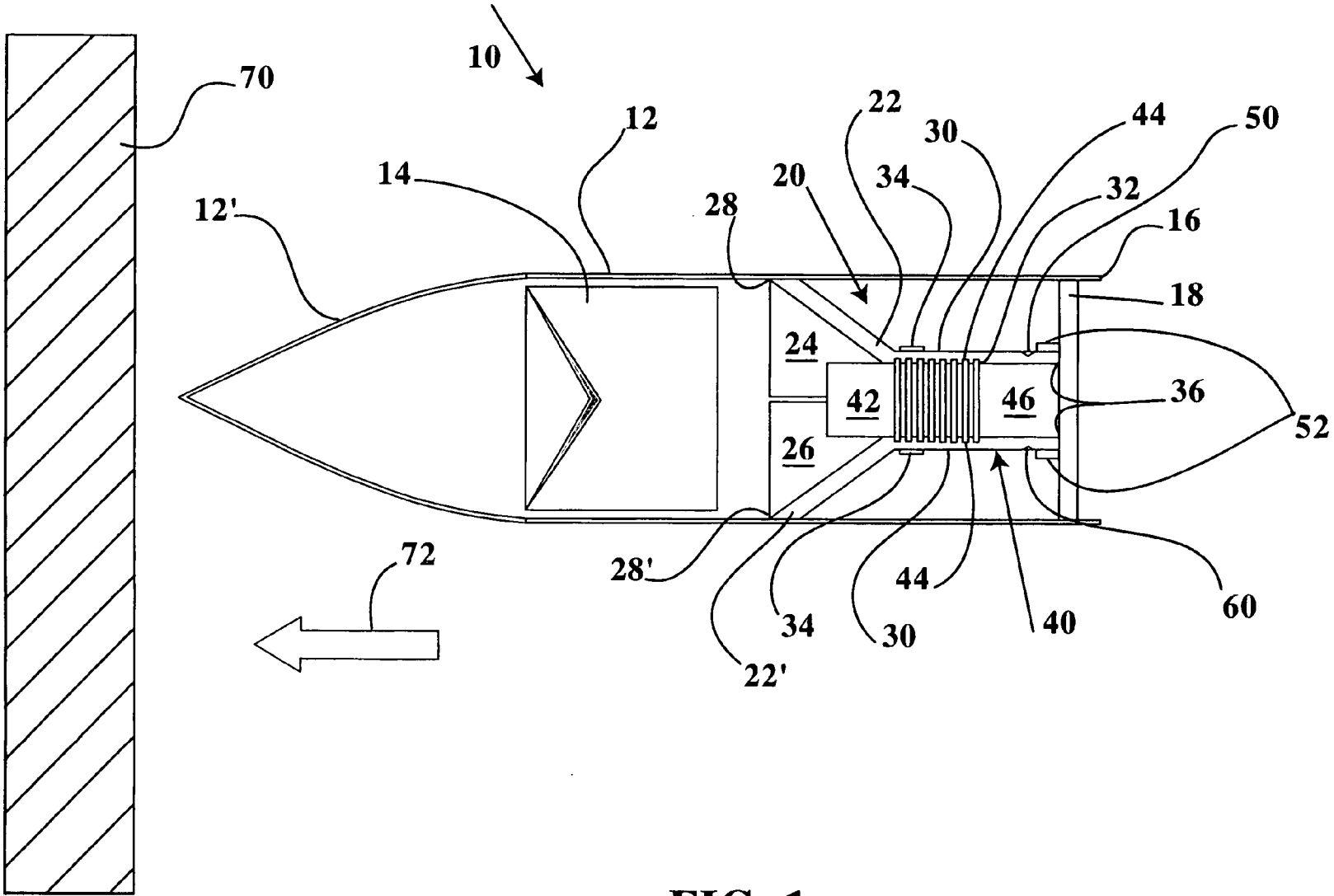
FIG. 1 is a perspective view of a missile-borne grenade release device of the present invention, enclosed within a munition shell.

Referring now to FIGS. 1–7B, a missile-borne release device 10 is disclosed including a forwardly disposed first explosive device 14 and a rearwardly disposed second explosive device 40 axially aligned within a munition shell 12. The release device 10 within the munition shell 12 is delivered to a hardened target surface 70 for sequential detonation of the first explosive device 14 followed by detonation of the second explosive device 40 to generate sequential and forwardly directed high pressure gas and shock waves of sufficient magnitude to breach the hardened target surface 70. The release device 10 is readily utilizable by infantry and is adaptable for release from piloted or remote controlled aircraft, and vehicles transporting and/or supporting infantry during urbane warfare. The release device 10 is further utilizable in the commercial demolition industry for destruction of hardened structures by directed delivery of multiple explosive devices having sufficient destructive capabilities but not excessive explosive capability compared to prior used high explosive packages.

Figure 2:
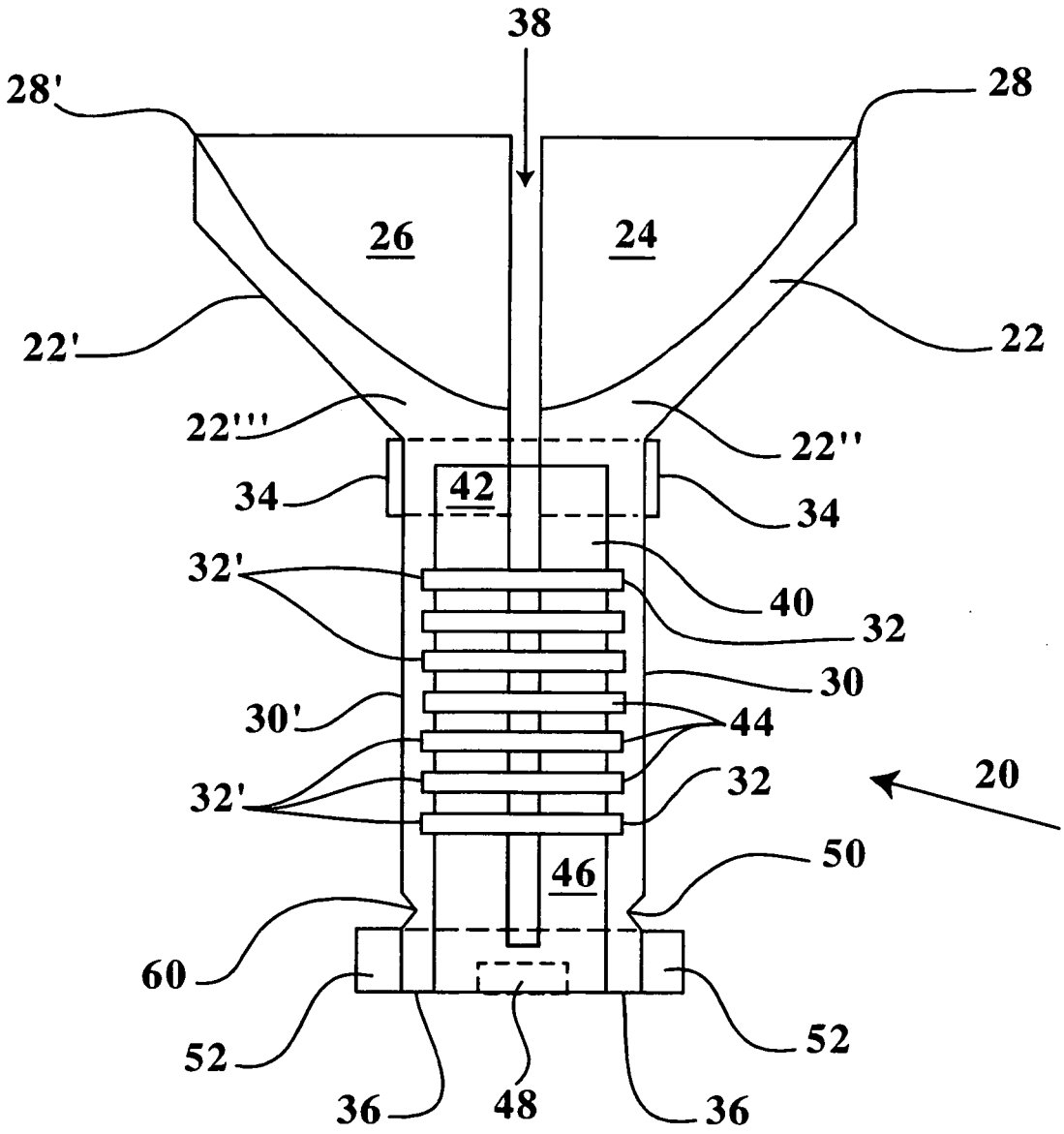
FIG. 2 is a cross-sectional view of the release device of FIG. 1.
Figure 3A:
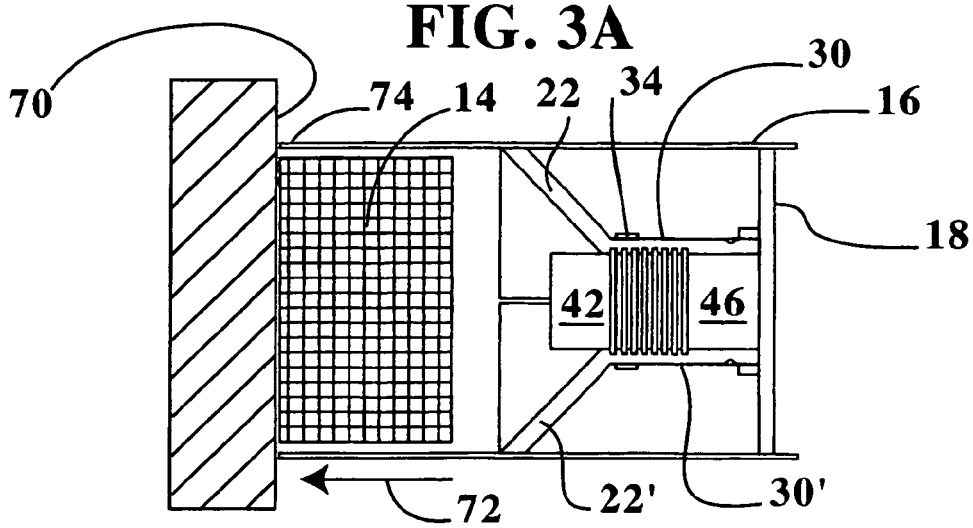
FIGS. 3A through 3G are side views of a typical operational sequence for activation of the release device and directed delivery of multiple explosive charges.
Figure 3B:
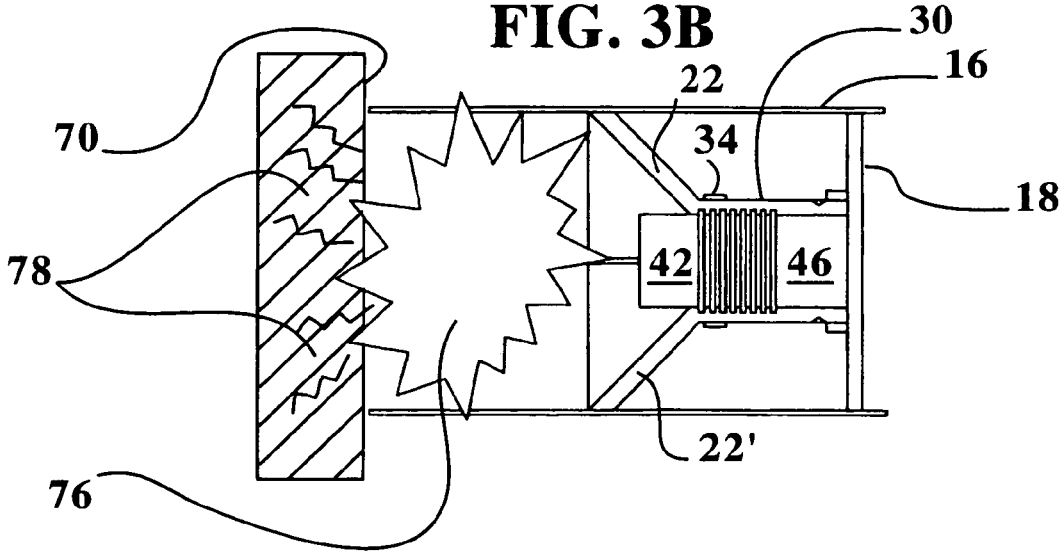
Figure 3C:
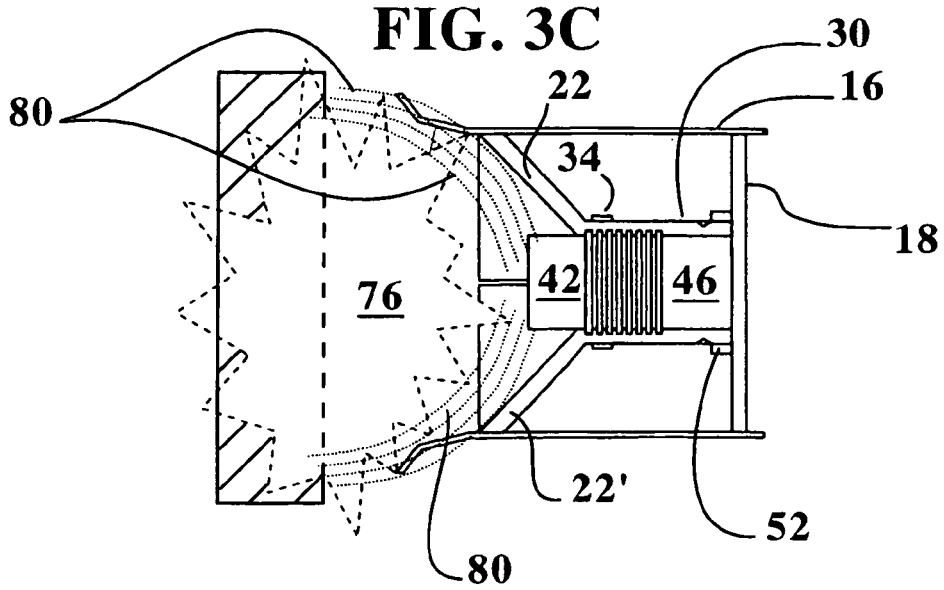
Figure 3D:
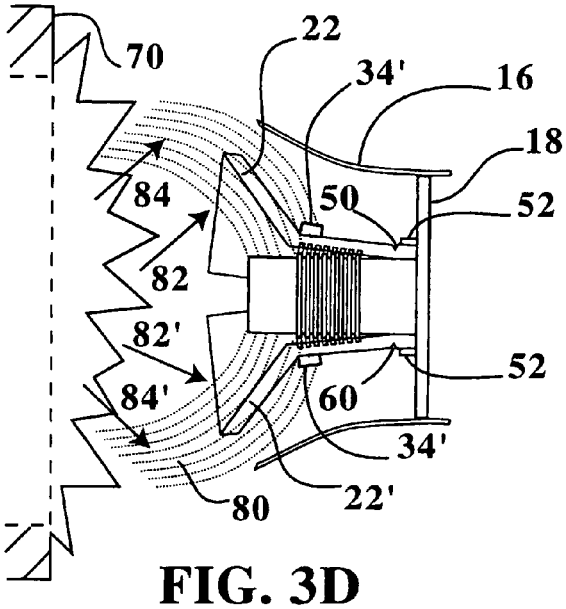
Figure 3E:
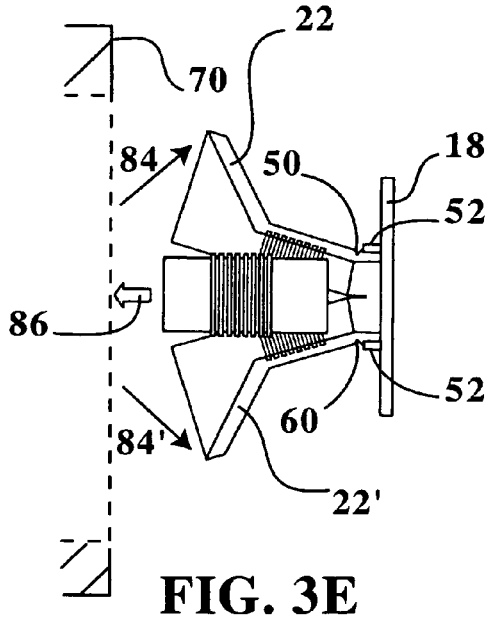
Figure 3F:
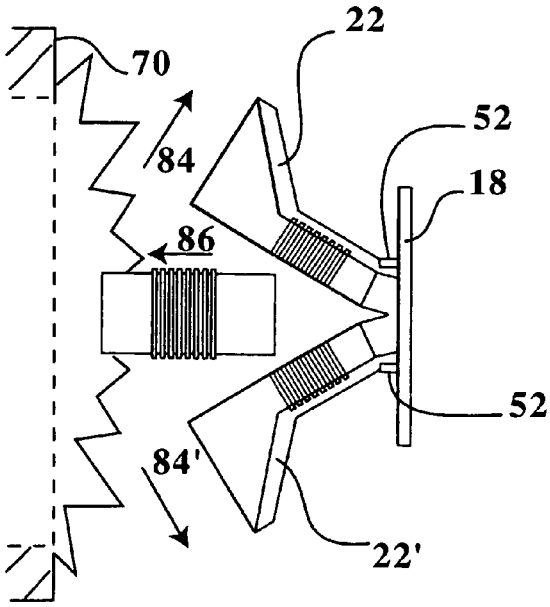
Figure 3G:
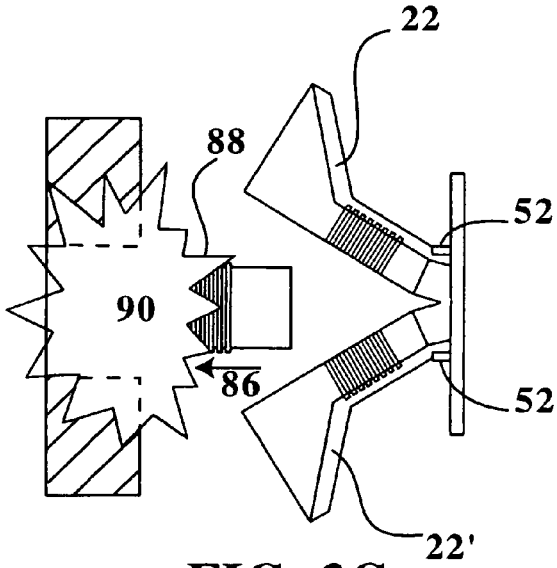

The release device 10 includes an elongated release body 20 which is longitudinally split 38 into a first forwardly extended partial cone portion 22, 24 and a second partial cone portion 22', 26 (see FIG. 2). Each partial cone portion includes leading edges 28, 28' extend forward to a first or forward cone diameter comparable to the diameter of a rear portion of the first explosive device 14 (see FIG. 1). The leading edges 28, 28' are positioned at a spaced apart distance rearward of the first explosive charge 14 in order to initially receive rearward directed high pressure gasses from detonation of the first explosive device 14. The respective partial cone interior surfaces 24, 26 extend rearward at an inwardly decreasing angle to a second or middle diameter forming cone base portions 22", 22'", from which at least two partial cylindrical mid-segments 30, 30' extend the rearward length of the shell or frame 12. The mid-segments 30, 30' are joined together by a forward securing ring 34 and a rear securing ring 52. The forward securing ring 34 is positioned and affixed rearward of the base portions 22", 22'" of partial cone portions 22, 22' so as to form a temporary binding against which the base portions 22", 22'" will be forced during cone expansion 82, 82' after detonation of the first explosive charge 14 (see FIGS. 3C through 3F). The forward securing ring 34 is designed to include features allowing the ring to mechanically fail 34' when rearwardly directed high pressure gases impact and force the partial cone outer frame 22, 22', cone interior surfaces 24, 26, and base portions 22", 22'" to expand 82, 82' (see FIG. 3D). The release body 20 is manufactured with any of numerous readily available materials including, but not limited to, metals, plastics, ceramics, and/or composite materials combined with any of the above materials.

The cylindrical mid-segments 30, 30' are configured to include a length and diameter adequate to enclose the second explosive device 40 therein, such as a grenade (see FIG. 2). The mid-segments 30, 30' extend rearward from the cone base portions 22", 22'" to the rear portions 36 of the release body 20. The rear portions 36 are preferably configured to be positioned in abutting relationship with a rear frame or plate 18 forming a detachable rear closure and support surface for the munition shell or frame 12. Access to the release body 20 for maintenance and inspections is provided by removing the rear frame or plate 18 from connection with rear portions 16 of the munition shell 12. Within the mid-length of the release body 20, multiple interface grooves 32, 32' are indented and aligned in the inner faced surface of respective mid-segments 30, 30'. The interface grooves 32, 32' are sized and spaced to provide interconnection with a plurality of protrusions 44 extending from a mid-portion exterior surface of the second explosive charge 40. One skilled in the art will recognize that alternative configurations for the interior of the respective mid-segments 30, 30' and the exterior surface of the second explosive charge 40 can include reversed configurations having a plurality of protrusions or ribs extending from the interior of the release body mid-segments 30, 30', and a plurality of adequately sized grooves positioned within the exterior surface of the second explosive charge 40. A further alternative fixation structure other than grooves 32, 32' can include a frame (not shown) of connectors encircling the second explosive charge 40 but disposed within the release body mid-segments 30, 30'. The alternative frame would be intentionally designed to fail upon detonation of first explosive unit charge 14 in order to release the second explosive charge 40 toward the target surface 70 to provide a delayed delivery of the second explosive charge 40 after detonation of the first explosive unit charge 14.

Figure 6:
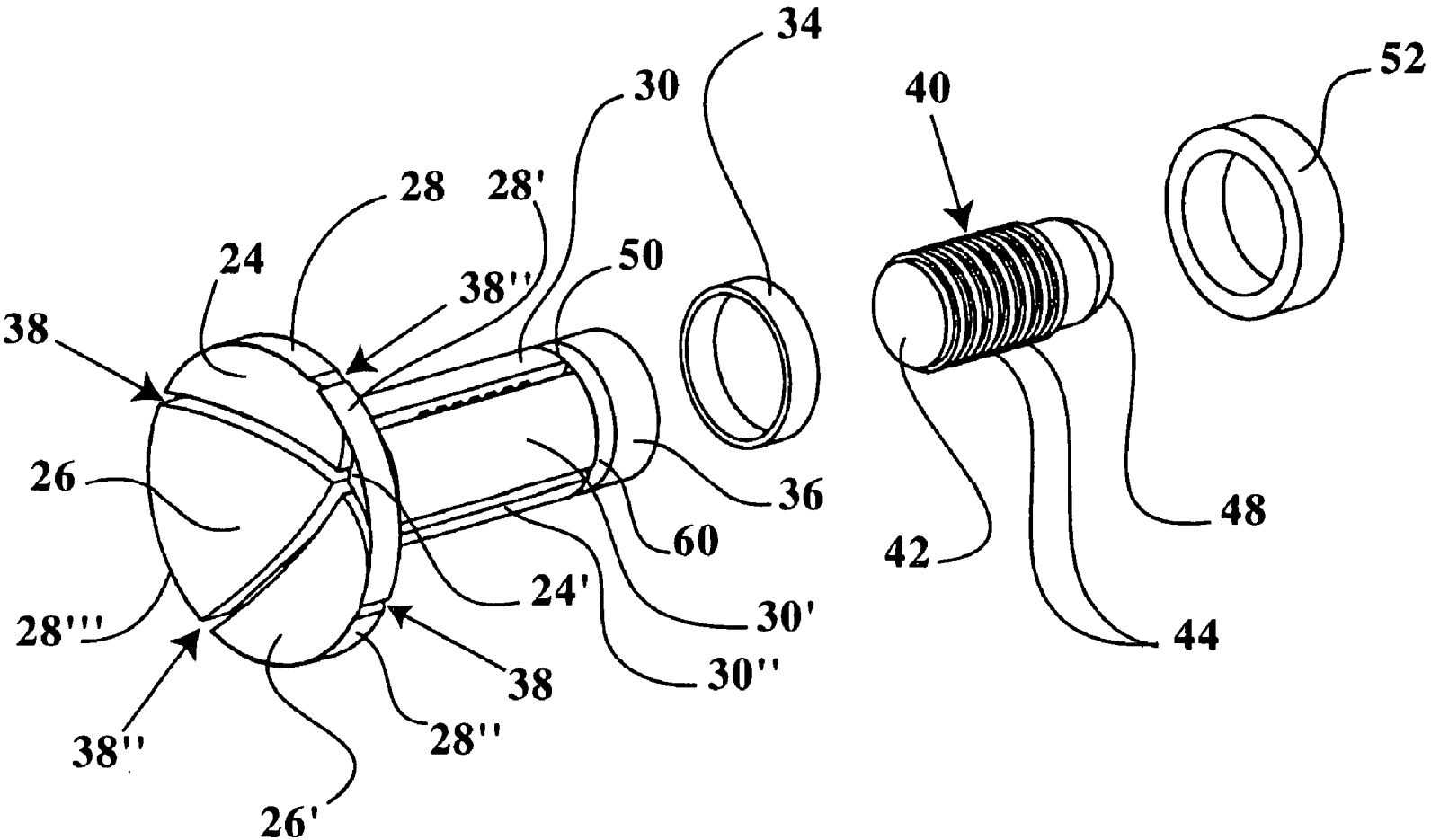
FIG. 6 is an exploded view of an alternative release device.
Figure 7A:
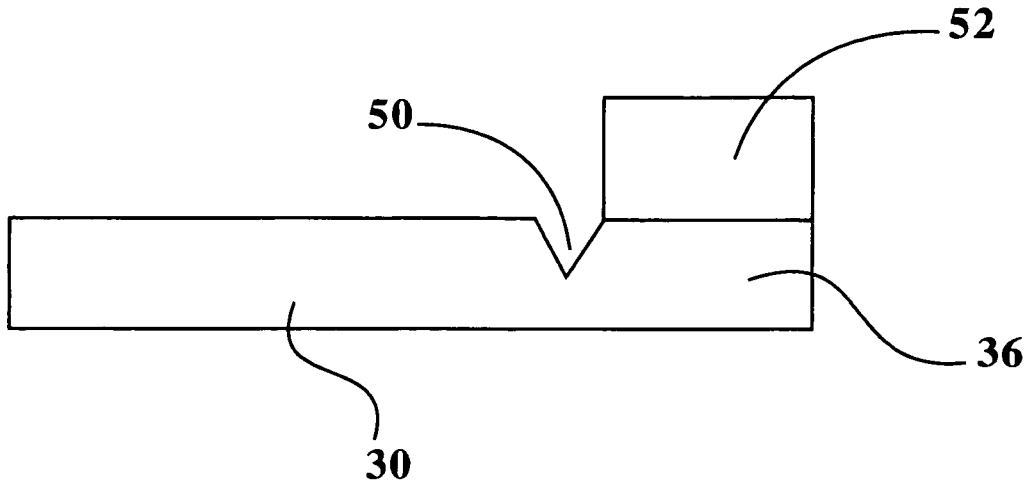
FIGS. 7A and 7B are cross-sectional views of a hinged configuration provided by a groove in outer rear surfaces of the segmented cylindrical units of the release device.
Figure 7B:
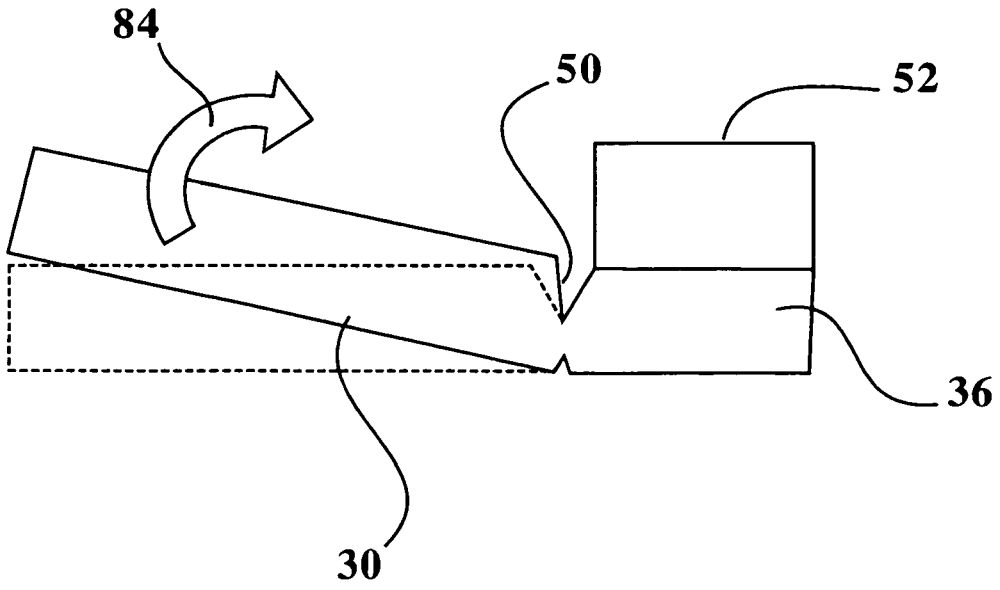

The respective rear portions of each cylindrical mid-segment 30, 30' include a circumferential indentation configured as v-shaped indentations 50, 60 which extend within the outer circumference of the rear end 36 immediately forward of the position of the second retaining ring 52 (see FIGS. 6, 7A and 7B). The v-shaped indentations 50, 60 serve as hinged sections about which each cylindrical mid-segment 30, 30' is inclined to pivot outwardly and apart from the lengthwise axis of the release body 20 upon detonation of the first explosive device 14. Pivoting of the rear end 36 of the release device 20 is limited by the rear securing ring 52 located proximal to and rearwards of the v-shaped indentations 50, 60 (see FIGS. 2, 3D–3F).

Operation of the missile-borne release device 10 includes delivery of the munition shell 12 along a flight path 72 to a target surface 70 (see FIG. 1) by an accurate hand-toss by a soldier, or by mechanical means such as a launch tube, grenade launcher, or a similar mechanical device known to those skilled in the art of warfare. Upon the munition shell 12 being delivered to impact 74 the target surface 70 (see FIG. 3A), the first explosive charge 14 is detonated 76 (see FIG. 3B) by contact with the target surface 70, or by ignition utilizing radio frequency or other signal transmissions received by the first explosive charge 14 from an operator controlled transmission device (not shown). As the front portion 12' of the munition outer shell 12 fails due to overpressure from the explosion (see FIGS. 3B and 3C), surface shock waves 78 are created by high pressure gases 80 from detonation of the first explosive charge 14, with a portion of the gases being deflected from the target surface 70 with resulting impingement of gases upon the forward cone surfaces 22, 24, 22', 26. The forces generated by the impingement of gasses 80 on the forward cone surfaces 22, 24, 22', 26 move the cone surfaces to rotate outwards 84, 84' and rearwardly (see FIGS. 3D and 3E). The forward securing ring 34 fails as stress builds in the base area 22", 22'" of the cone structure. Failure of the forward securing ring 34 allows the cone structure 22, 22' and respective cylindrical mid-segments 30, 30' to rotate outwards 84, 84' and rearwardly relative to v-shaped indentations 50, 60 serving as hinges forward of the securing ring 52 encircling the release body rear end 36.

During rotation outwards 84, 84' and rearwards of the respective partial cone portions 24, 26 after detonation of first explosive device 14, the grenade protrusions 44 are released from contact with grooves 32, 32' on the interior surfaces of respective cylindrical mid-segments 30, 30'. The grenade 40 is then free to move forward 86 (see FIGS. 3E–3G) due to momentum from the arrested flight of the munition shell 12 against the target surface 70, thereby positioning the grenade 40 proximal of the weakened target surface 70 for detonation 88 of the grenade 40 to generate a depression or a breach 90 in the target surface 70 (see FIG. 3G).

An alternative embodiment of the release mechanism is designed such that high-pressure gases from the detonation of the first explosive device 14 are funneled through channels (not shown) through or around the cone structure 22, 24, 22', 26 of the release device 20. With the addition of channels or holes in the rear side walls of the release device 20, the gases would pressurize a void 48 behind or within the rear 46 of the grenade 40 (see FIG. 2). The expansion of these gases in the void 48 on the grenade rear end 46 positioned against the rear plate 18 of the munition shell 12, would serve as a forward propelling charge for the grenade 40. An additional release mechanism can be provided by a propulsion charge positioned within void 48, with the propulsion charge being activated to provide additional forces acting on the grenade rear end 46 to provide forward propelling of the grenade 40. The propulsion charge, if utilized, would be activated remotely or by sensor circuitry interconnected to sense outwards and rearwards movement of cone structures 22, 24, 22', 26.

An alternative embodiment of the forwardly extended cone structure is illustrated in FIGS. 4–6, and includes cone portions 22"", 22'"" having flattened first and second leading edges 28", 28'" which are initially impacted by rearward directed high-pressure gases from detonation of the first explosive device 14. As illustrated in FIGS. 4 and 5, the cone portions 22"", 22'"" are longitudinally split 38, 38" into four forwardly extended cone portions 24", 24'", 26", 26'". The four cone portions include flattened leading edges 28", 28'" extending forward to a first or forward cone diameter comparable to the diameter of a rear portion of the first explosive device 14 (see FIG. 1). The four cone portions include respective partial cone interior surfaces 24", 24'", 26", 26'" which extend rearward at an inwardly decreasing angle to the second or middle diameter forming cone base portions 22", 22'", from which four partial cylindrical mid-segments 30, 30', 30", 30'" extend to the rear end 36 of the release body 20. The mid-segments 30, 30', 30", 30'" are joined together during flight of the missile-borne release device 10 by forward securing ring 34 and rear securing ring 52 (see FIGS. 4 and 6). The four cone portions are forced outwardly and rearwardly upon detonation of the detonation of the first explosive device 14 with resulting release of the grenade 40 and movement forward 86 for detonation against the target surface 70 (see FIG. 3G).

While numerous embodiments and methods of use for this invention are illustrated and disclosed herein, it will be recognized that various modifications and embodiments of the invention may be employed without departing from the spirit and scope of the invention as set forth in the appended claims. Further, the disclosed invention is intended to cover all modifications and alternate methods falling within the spirit and scope of the invention as set forth in the appended claims.

What is claimed is:

1. A device for delivery and release of multiple explosive charges on target, comprising:

a shell having a diameter sized to be delivered to a target by hand;

a first explosive charge supported in a forward portion of said shell;

a release device positioned in axial alignment and rearward of said first explosive charge, said release device including:

a segmented cone having a forwardly extended cone rim of a sufficient diameter to be positioned proximal and rearward of said first explosive charge, said cone having a base with a diameter less than said cone rim diameter; and a segmented cylindrical unit extending rearwardly from respective portions of said cone base diameter, said segmented cylindrical unit having a front end extending from said cone base and having a rear end supported rearward in said shell;

a second explosive charge releasably held within said segmented cylindrical unit, said second explosive charge positioned in axial alignment with said first explosive charge; and at least one securing ring encircling said segmented cylindrical unit in a circumferential position to maintain enclosure of said second explosive charge by said segmented cylindrical unit during delivery of said shell to the target;

whereby upon impact of said shell with the target, said first explosive charge detonates with release of high pressure gases impacting the target and impacting said segmented cone resulting in forced outwardly separation of said segmented cone and said segmented cylindrical unit with release of said second explosive charge directed proximal of the target for impact and detonation against the target.

2. The device of claim 1, further comprising said segmented cylindrical unit including an outer surface segment proximal of said rear end in which a circumferential indentation is disposed, whereby said circumferential indentation provides a hinged segment about which segments of said cylindrical unit pivot outwardly and apart from said second explosive charge upon impacting said segmented cone with high pressure gases from detonation of said first explosive charge, thereby resulting in the outwardly separation of said segmented cone.

3. The device of claim 2 wherein said shell diameter including a sufficiently aerodynamic curved outer configuration extended from a forward portion to a rearward portion for optimal delivery to the target by hand or by mechanical means.

4. The device of claim 2 wherein said at least one securing ring including a forward restraining ring disposed in encircling relationship around said front end of said segmented cylindrical unit, said forward restraining ring maintains said segmented cylindrical unit in enclosing relationship around said second explosive charge until said segmented cone is forced to separate when subjected to high pressure gases upon detonation of said first explosive charge, thereby said forward restraining ring is breached resulting in outwardly opening of said segmented cone and said segmented cylindrical unit with release of said second explosive charge.

5. The device of claim 2 wherein said at least one securing ring including a rear restraining ring encircling said segmented cylindrical unit proximal of said rear end and rearward of said circumferential indentation, whereby said rear restraining ring is not immediately breached upon detonation of said first explosive charge and said rear end of said segmented cylindrical unit is maintained in a non-breached orientation until occurrence of said outwardly separation of said segmented cone and said front end of said segmented cylindrical unit with resulting delay in release of said second explosive charge toward the target after detonation of said first explosive charge.

6. A device for release of multiple explosive charges on a target, comprising:

a frame having a forward portion in which a first explosive charge is disposed, and having a rear portion in which an enclosed void space is provided;

a release device positioned within said void space in axial alignment and rearward of said first explosive charge, said release device including:

a segmented conical portion having a forwardly extended cone rim having a sufficient diameter to fit securely within said frame, said conical portion having a base of a reduced diameter relative to said cone rim; and at least two segmented cylindrical units extending rearward from said conical portion base, said segmented cylindrical units being joined together along an axial length extended rearwardly toward said frame rear portion;

a second explosive charge disposed within said segmented cylindrical units and aligned axially with said first explosive charge; and at least one securing ring encircling said segmented cylindrical units at a circumferential position forward of said frame rear portion;

whereby upon said frame forward portion being directed to impact the target, said first explosive charge is detonated with resultant release of high pressure gases impacting the target and impacting said segmented conical portion with resulting separation of said segmented cylindrical units and release of said second explosive for impact and detonation against the target.

7. The device of claim 6, further comprising each segmented cylindrical unit including an outer surface segment in which a circumferential indentation is disposed, whereby said circumferential indentation provides a hinged segment about which each cylindrical unit pivots outwardly and rearwards upon high pressure gases impacting said segmented conical portion and cone rim resulting in the outwardly separation of said segmented cone portion and said segmented cylindrical units thereby releasing said second explosive charge for delayed movement against the target.

8. The device of claim 7 wherein said at least one securing ring including a forward restraining ring disposed in encircling relationship around respective front ends of each segmented cylindrical unit and forward of said circumferential indentation, said forward restraining ring maintains said segmented cylindrical units in enclosing relationship around said second explosive charge until said segmented conical portion and said forward restraining ring are breached when subjected to high pressure gases from detonation of said first explosive charge thereby resulting in the outwardly separation of said segmented cone portion and said segmented cylindrical units thereby delaying release of said second explosive charge for movement to and detonation against the target.

9. The device of claim 8 wherein said at least one securing ring further including a rear restraining ring encircling said segmented cylindrical units rearward of said circumferential indentation, whereby said rear restraining ring is not immediately breached upon detonation of said first explosive charge thereby said rear ends of each cylindrical unit are maintained in adjacent orientation until sufficient outwardly pivoting and separation occurs between said segmented cylindrical units to allow release of said second explosive charge for delivery against the target.

10. A release device for sequentially separating a first explosive unit from a second explosive unit with delivery of each explosive unit to a target, comprising:

a shell having a curved outer configuration extended from a forward portion to a rear base portion to facilitate accurate delivery of said shell to a target;

a first explosive unit restrained within said forward portion of said shell, said first explosive unit is fixed within said shell until contact with said target resulting in detonation of said first explosive unit with release of high pressure gases;

a segmented conical portion having a conical rim disposed adjacently rearwards of said first explosive unit, said conical portion extended to a cone base having a base diameter less than said conical rim;

at least two partial cylindrical portions extended rearwardly in adjacent orientation from said cone base diameter, said partial cylindrical portions are disposed apart and having a diameter substantially equal to said cone base diameter, said partial cylindrical portions having interior surfaces in which a plurality of interior grooves are disposed in opposing alignment; and a second explosive unit disposed between said partial cylindrical portions, said second explosive unit having an exterior curved surface from which a plurality of protrusions extend radially therefrom;

whereby said second explosive unit protrusions mated with said interior grooves of said partial cylindrical portions, whereby said second explosive unit is retained within said partial cylindrical portions during flight to the target without axial movement of said first and second explosive units relative to each other; said conical portion forward oriented surfaces are subject to physical loading by the high pressure gases generated by detonation of said first explosive unit, said forward oriented surfaces are physically spread apart with resultant release of said second explosive unit from retention within said partial cylindrical portions by pivoting apart of respective segments of said partial cylindrical portions;

whereby said second explosive unit is released from said partial cylindrical portions for travel forward in a path coinciding with said first explosive unit impaction with the target resulting in detonation of said second explosive unit at the target.

11. The release device of claim 10 further comprising each partial cylindrical portion including a rear outer surface segment in which a circumferential indentation is disposed, said circumferential indentation provides a hinged segment about which each partial cylindrical portion pivots outwardly and apart from said second explosive unit upon high pressure gases impacting said cone rim resulting in the outwardly separation of said segmented cone.

12. The release device of claim 11 further comprising a forward restraining ring positioned in circumferential relationship around said partial cylindrical portions until subjected to physical loading and breach by detonation of said first explosive unit.

13. The release device of claim 11 further comprising a rear restraining ring encircling said partial cylindrical portions rearward of said circumferential indentation, whereby said rear restraining ring is not immediately breached upon detonation of said first explosive unit thereby said rear ends of said partial cylindrical portions are maintained in adjacent orientation until sufficient outwardly separation occurs between said partial cylindrical portions to allow release of said second explosive unit for delivery against the target.

14. The release device of claim 11 further comprising a propulsion charge disposed rearwardly of said second explosive unit and retained within said shell rear base portion, whereby said propulsion charge is activated upon detonation of said first explosive unit thereby providing expedited forward movement of said second explosive unit coinciding with each partial cylindrical portion pivoting outwardly and releasing said second explosive unit for impact and detonation at the target.

* * * * *